US007707664B1

(12) United States Patent
Flynn

(10) Patent No.: US 7,707,664 B1
(45) Date of Patent: May 4, 2010

(54) BATHROOM CLEANSING APPARATUS

(76) Inventor: James P. Flynn, 104 Mobrey La., Smithtown, NY (US) 11787

( * ) Notice: Subject to any disclaimer, the term of this patent is extended or adjusted under 35 U.S.C. 154(b) by 1048 days.

(21) Appl. No.: 11/356,993

(22) Filed: Feb. 21, 2006

(51) Int. Cl.
*A47K 3/20* (2006.01)

(52) U.S. Cl. ..... 4/570; 4/615; 4/675

(58) Field of Classification Search ..... 4/567–570, 4/615–617, 675, 678; 239/195, 238, 58; 137/559, 560, 801
See application file for complete search history.

(56) References Cited

U.S. PATENT DOCUMENTS 824,454 A 6/1906 Vanderman
3,110,038 A 11/1963 Dornbierer
4,926,511 A 5/1990 Coll
5,027,450 A * 7/1991 Lang ..... 4/541.6
5,093,942 A * 3/1992 Lang ..... 4/541.6
5,966,752 A 10/1999 Abugideiri
6,470,510 B2 10/2002 Nasr et al.
7,065,807 B1 * 6/2006 Stout, Jr. ..... 4/615

* cited by examiner

*Primary Examiner*—Huyen Le
(74) *Attorney, Agent, or Firm*—Crossley Patent Law; Mark A. Crossley

(57) ABSTRACT

A bathroom cleansing apparatus for use by individuals when taking a shower. The bathroom cleansing apparatus is an improved showerhead which is attached to a length of flex hose. The flex hose itself is not normally visible when the shower head is not in use, but rather, is attached to a spool that is axially mounted behind a shower wall. The flex hose winds around the spool a few times before being attached to an incoming water line. The spool itself is attached to a torsion spring, which will cause the apparatus to slowly pull any extra length of flex hose not being used back onto the spool for later use.

1 Claim, 4 Drawing Sheets

BATHROOM CLEANSING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved bathroom cleansing apparatus for use by individuals to use when taking a shower.

DESCRIPTION OF THE PRIOR ART

U.S. Pat. No. 6,470,510 B2, issued to Nasr et al., discloses a shower assembly for use as a stationary shower or a hand-held shower and includes a housing, hose, and a shower head.

U.S. Pat. No. 5,966,752, issued to Abugideiri., discloses a baby bath that includes a tub and a showerhead.

U.S. Pat. No. 4,926,511, issued to Coll, discloses a movable shower assembly that has an automatically retracting hose and a shower head capable of taking up multiple positions.

U.S. Pat. No. 3,110,038, issued to Dornbierer, discloses a sink or tub mixing-faucet assembly with a flexible supply hose for particular use for toilet and bathrooms.

U.S. Pat. No. 824,454, issued to Vanderman, discloses a bathtub that has means for admitting water thereto which are located appurtenant to or secured to the tub.

SUMMARY OF THE INVENTION

The present invention concerns that of a new and improved bathroom cleansing apparatus for use by individuals when taking a shower. The bathroom cleansing apparatus is an improved showerhead which is attached to a length of flex hose. The flex hose itself is not normally visible when the shower head is not in use, but rather, is attached to a spool that is axially mounted behind a shower wall. The flex hose winds around the spool a few times before being attached to an incoming water line. The spool itself is attached to a torsion spring, which will cause the apparatus to slowly pull any extra length of flex hose not being used back onto the spool for later use.

There has thus been outlined, rather broadly, the more important features of a bathroom cleansing apparatus that the detailed description thereof that follows may be better understood and in order that the present contribution to the art may be better appreciated. There are, of course, additional features of the bathroom cleansing apparatus that will be described hereinafter and which will form the subject matter of the claims appended hereto.

In this respect, before explaining at least one embodiment of the bathroom cleansing apparatus in detail, it is to be understood that the bathroom cleansing apparatus is not limited in its application to the details of construction and to the arrangements of the components set forth in the following description or illustrated in the drawings. The bathroom cleansing apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present bathroom cleansing apparatus. It is important, therefore, that the claims be regarded as including such equivalent constructions insofar as they do not depart from the spirit and scope of the present invention.

It is therefore an object of the present invention to provide a bathroom cleansing apparatus which has all of the advantages of the prior art and none of the disadvantages.

It is another object of the present invention to provide a bathroom cleansing apparatus which may be easily and efficiently manufactured and marketed.

It is another object of the present invention to provide a bathroom cleansing apparatus which is of durable and reliable construction.

It is yet another object of the present invention to provide a bathroom cleansing apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
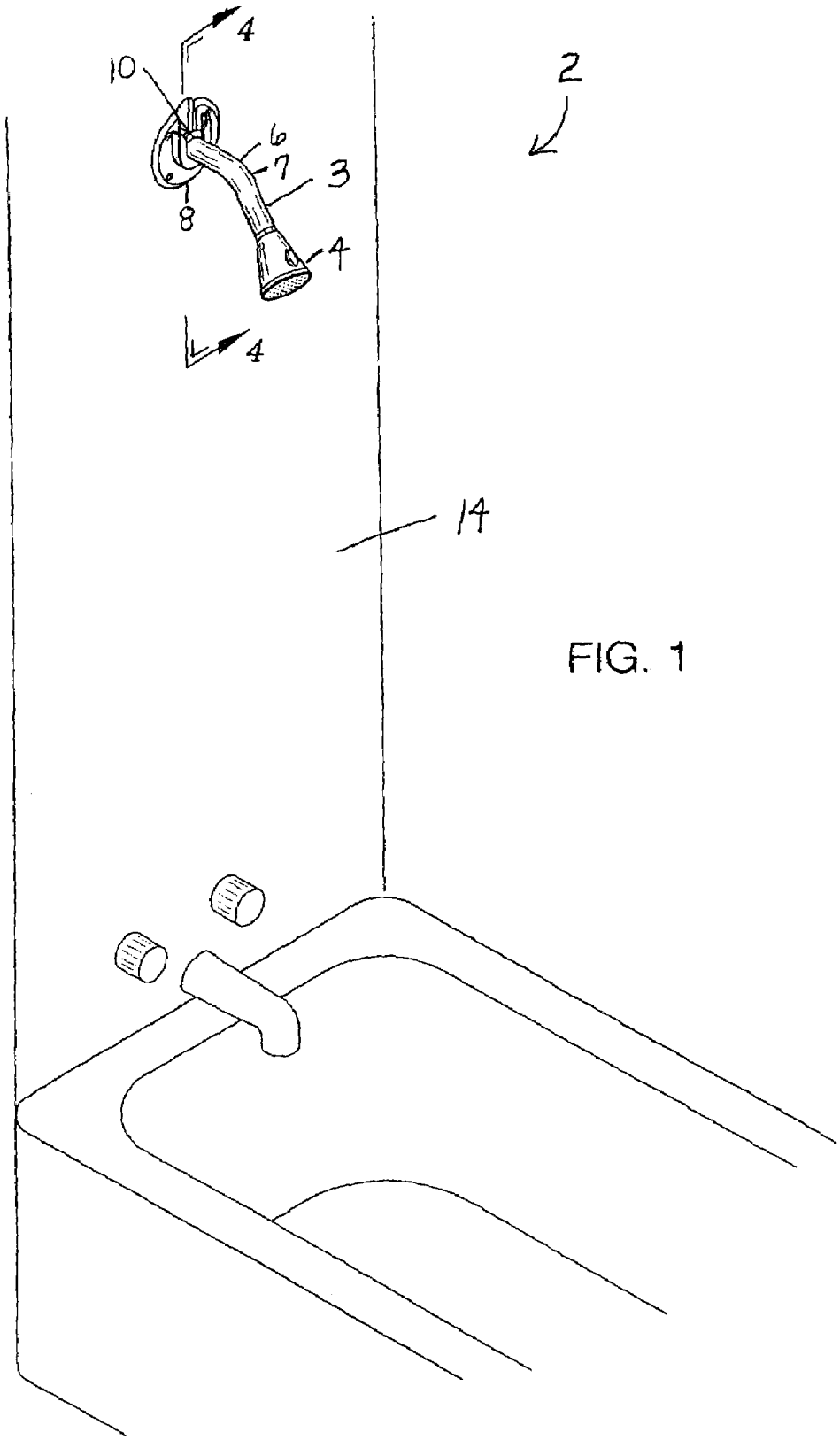
FIG. 1 shows a front perspective view of the bathroom cleansing apparatus.
Figure 2:
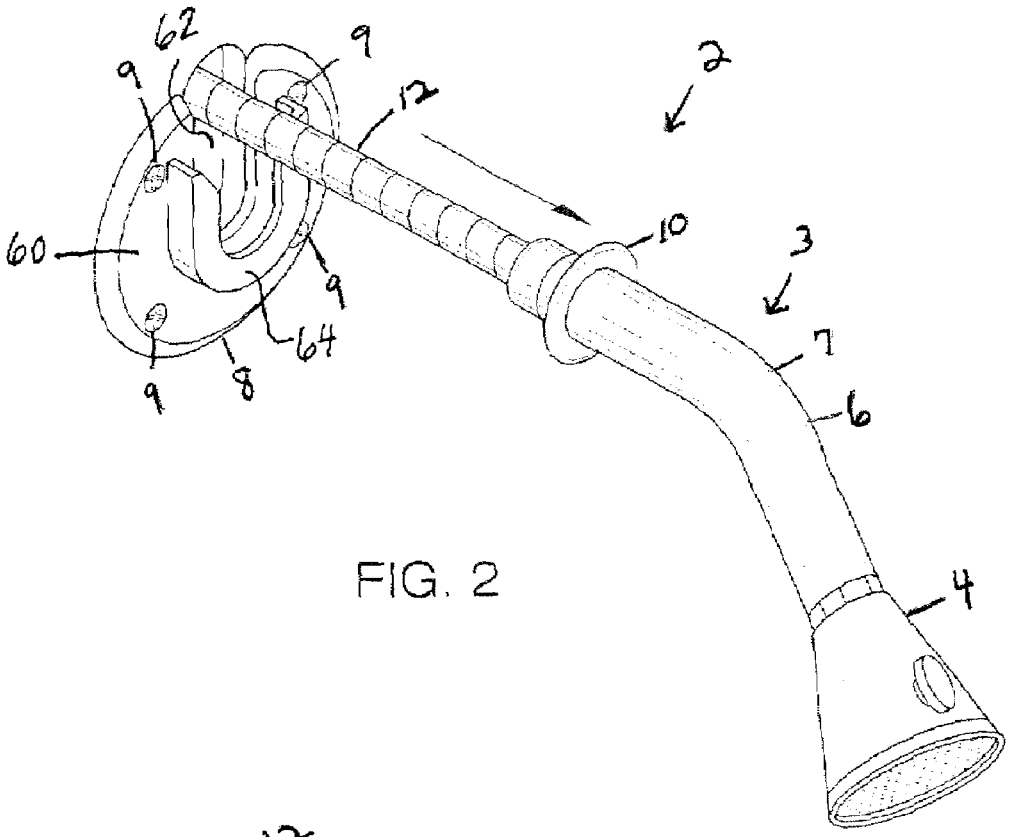
FIG. 2 shows a close-up front perspective view of the shower head and shower head mount of the bathroom cleansing apparatus.
Figure 3:
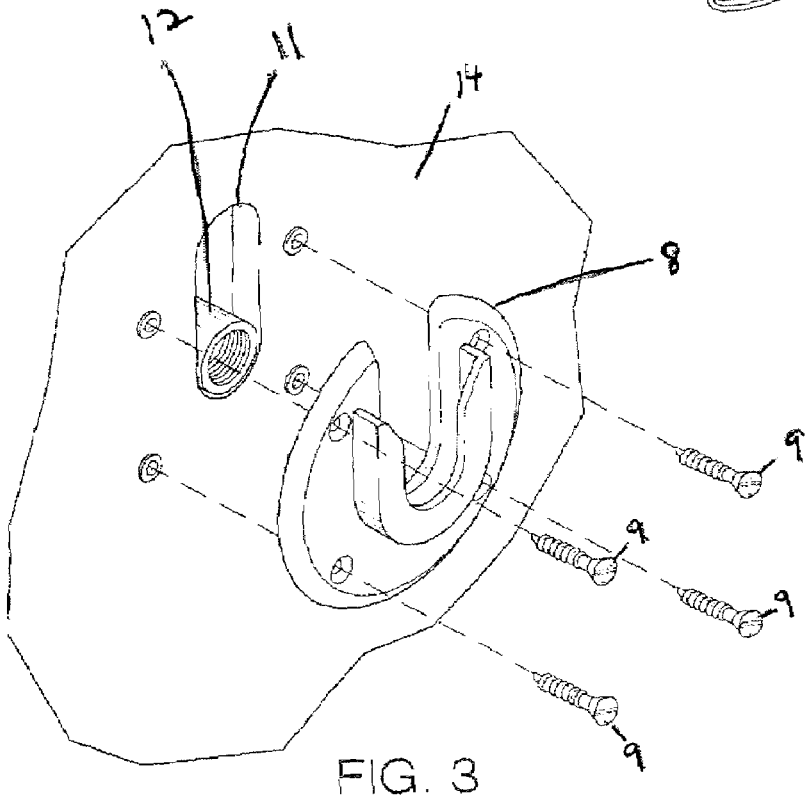
FIG. 3 shows a close-up front perspective view of the shower head mount and the attachment means used to mount the shower head mount to a shower wall.
Figure 4:
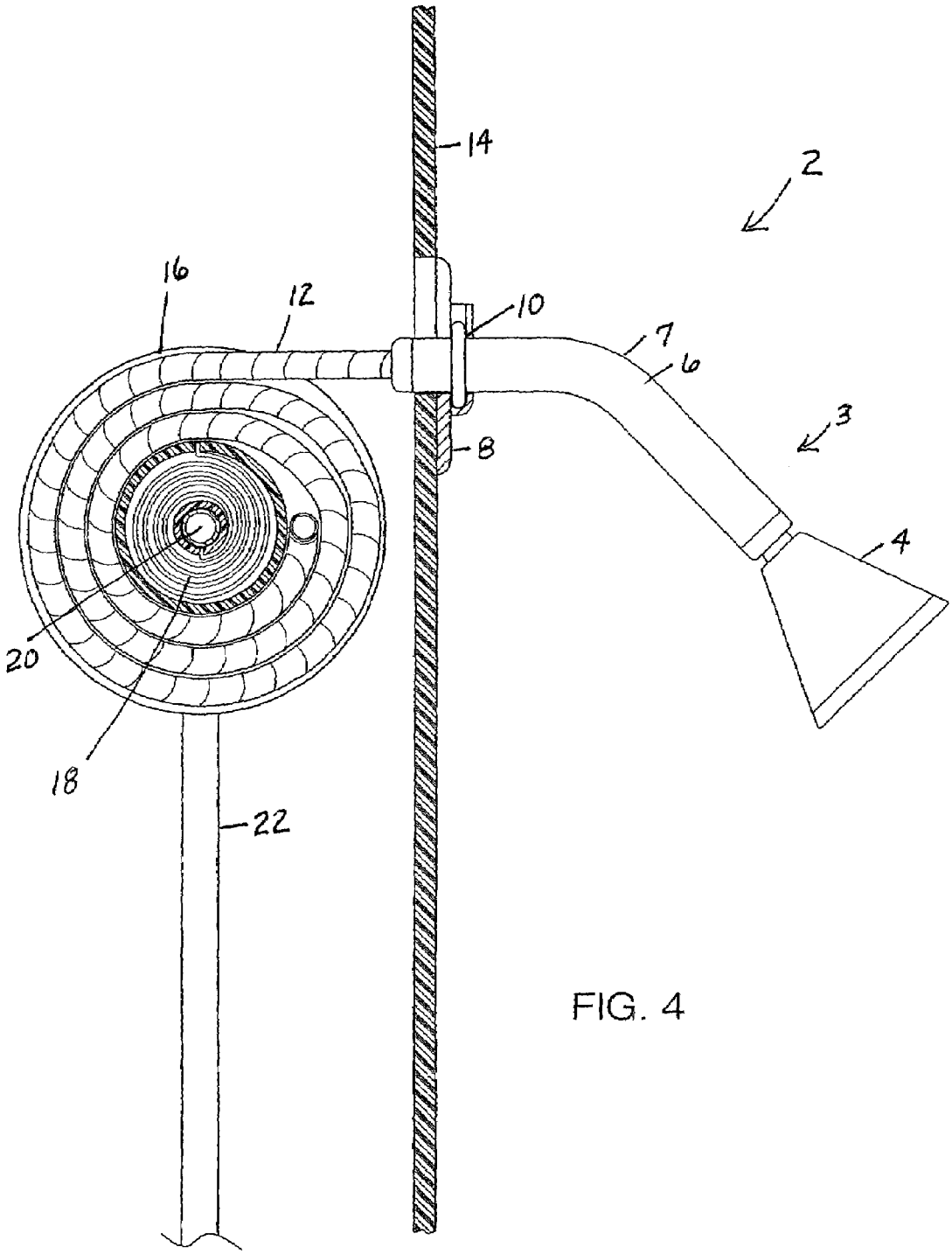
FIG. 4 shows a side view of the bathroom cleansing apparatus.
Figure 5:
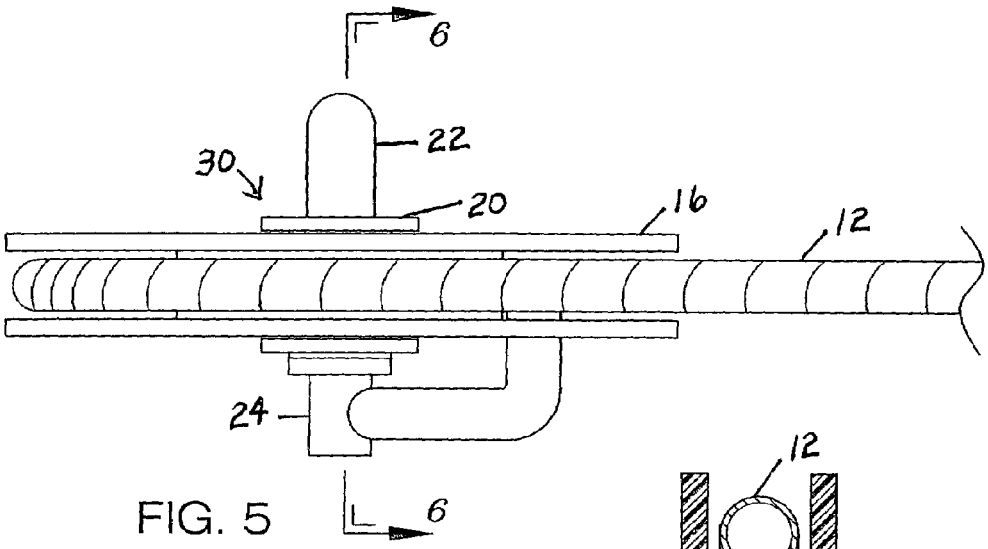
FIG. 5 shows a top view of the spool used with the bathroom cleansing apparatus.
Figure 6:
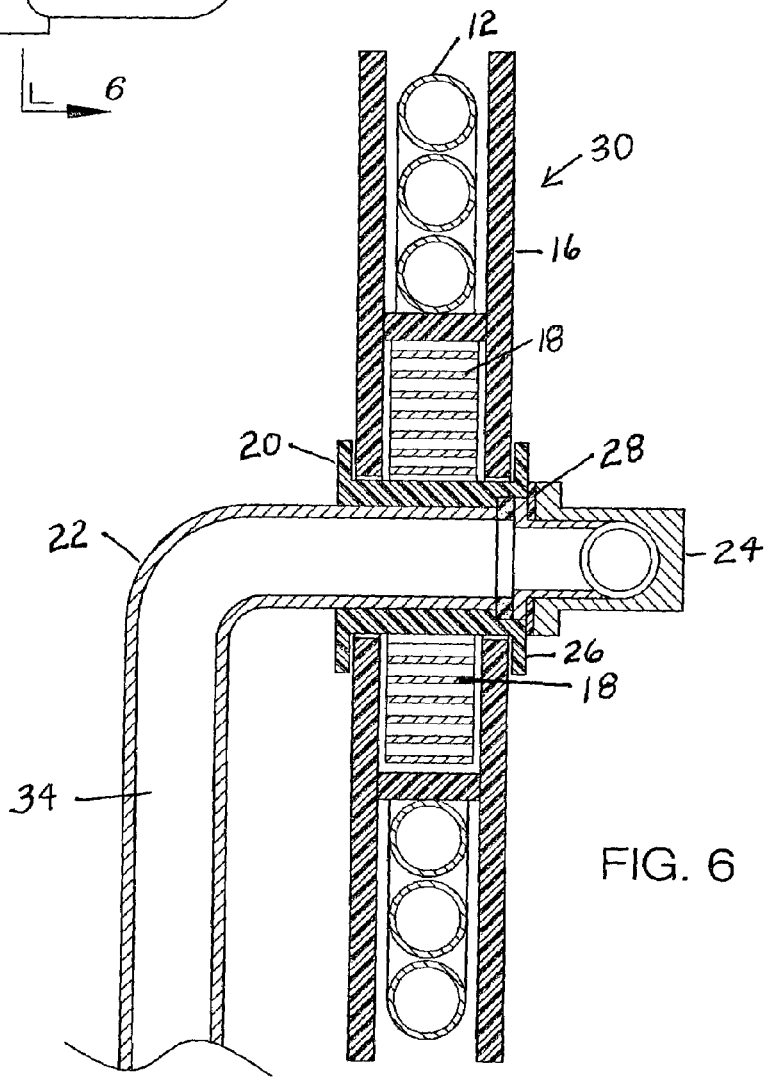
FIG. 6 shows a side view of the spool used with the bathroom cleansing apparatus and its attachment to the incoming water line.

With reference now to the drawings, and in particular to FIGS. 1 through 6 thereof, a new bathroom cleansing apparatus embodying the principles and concepts of the present invention and generally designated by the reference numeral 2 will be described.

As best illustrated in FIGS. 1 through 6, a bathroom cleansing apparatus 2 comprises a shower head 3 which comprises an outflow pipe 6 and a water dispenser 4. The outflow pipe 6 has two ends comprising an inner end and an outer end, with the water dispenser 4 being attached to the outer end of the outflow pipe 6. The outflow pipe 6 preferably has a small elbow bend 7 in it.

The bathroom cleansing apparatus 2 further comprises a flex hose 12 that has a length between four to six feet. The flex hose 12 has two ends, a first end and a second end, with the first end of the flex hose 12 being connected to the inner end of the outflow pipe 6. The flex hose 12 is preferably extended through a hole 11 that is located in a shower wall 14.

Behind the shower wall 14, the bathroom cleansing apparatus 2 further comprises a spool 30 that is axially mounted. The spool 30 includes an internal torsion spring 18 that continually provides continual force in one particular direction. Most of the length of the flex hose 12 is wound around the spool 30, with the internal torsion spring 18 continually providing an inward pulling direction on the flex hose 12, thereby causing the length of flex hose 12 to normally be wound around the spool 30 when it is not in use. A hose guide 16 provides boundary wall protection that keeps the flex hose 12 in an orderly, stacked fashion when it is wound around the spool 30.

The second end of the flex hose 12 is connected to a rotating hose connector 24, which in turn is connected to a centrally located water line 22. The water line 22 and the rotating hose connector 24 are connected through a centrally located spindle 20. The water line 22 is eventually connected to a water source 32 and is stationary when the spool 30 rotates around when the flex hose 12 is being pulled away or placed back onto the spool 30. However, the rotating hose connector 24 rotates when the spool 30 rotates. The rotating hose connector 24 can do this because they are mounted on a rubber gasket 26 and a spacer 28 which allow rotatability for the rotating hose connector 24, while at the same time, provide a sealed continuum for the water 34 from the water source 32 to flow through until it reaches the shower head 3 of the bathroom cleansing apparatus 2.

The bathroom cleansing apparatus 2 further comprises a shower head mount 8, which can be mounted on the shower wall 14 by attachment means 9, with the attachment means 9 preferably being a plurality of screws 9. A bracket 10 can be attached to the outflow pipe 6 of the shower head 3, with the bracket 10 capable of being placed within the shower head mount 8. This way, the shower head 3 can be properly mounted against the bathroom wall 14, while at the same time, be ready for immediate use by an individual when needed. The shower head mount 8 includes a base 60 having a U-shaped notch 62 therein and a corresponding U-shaped holder member 64. The U-shaped notch 62 and the U-shaped holder member 64 slidably receive bracket 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A bathroom cleansing apparatus comprising:

a shower head, the shower head being associated with a shower wall, a hose having two ends, a first end and a second end, the first end of the hose being attached to the shower head, the hose having a length, means for mounting the length of the hose, means for mounting the shower head onto the shower wall, a water source, means for connecting the water source to the hose, wherein the shower head further comprises:

an outflow pipe having two ends, an inner end and an outer end, a water dispenser attached to the outer end of the outflow pipe, wherein the first end of the flex hose is attached to the inner end of the outflow pipe, wherein the outflow further comprises an elbow bend, wherein the hose further comprises a flex hose, wherein the hose has a preferable length between four to six feet, wherein the means for mounting the length of the hose further comprises:

a spool that is axially mounted, an internal torsion spring located within the spool, the internal torsion spring continually providing force in one particular direction, wherein most of the length of the hose is wound around the spool, wherein the length of hose passes through a hole in the shower wall, wherein the internal torsion spring continually provides an inward pulling force upon the spool, thereby causing the length of flex hose to be wound around the spool when it is not in use, wherein the spool further comprises a hose guide, wherein the hose guide provides boundary wall protection that maintains the hose in an orderly, stacked position when wound around the spool, wherein the means for connecting the water source to the hose further comprises a rotating hose connector, a spindle centrally located on the spool, the rotating hose connector being attached to the spindle, a water line connected to the spindle, wherein the water line is connected to the water source, wherein the water line is stationary when the spool rotates, further wherein the rotating hose connector rotates when the spool rotates, wherein the means for mounting the shower head onto the shower wall further comprises:

a shower head mount comprising a base having a U-shaped notch therein, a U-shaped holder member corresponding to the U-shaped notch, the U-shaped notch and the U-shaped holder member slidably receiving the bracket therein, attachment means for attaching the shower head mount onto the shower wall, a bracket attached to the outflow pipe, wherein the bracket can be mounted within the shower head mount for temporary placement of the shower head, wherein the attachment means for attaching the shower head mount onto the shower wall further comprises a plurality of screws, wherein the screws are used to secure the shower head mount against the shower wall.

* * * * *